US009127921B2

(12) United States Patent
Koekemoer et al.

(10) Patent No.: US 9,127,921 B2
(45) Date of Patent: Sep. 8, 2015

(54) DETONATOR DEVICE COMMUNICATION

(71) Applicant: DETNET SOUTH AFRICA (PTY) LTD, Sandton (ZA)

(72) Inventors: Andre Koekemoer, Sandton (ZA); Craig Charles Schlenter, Sandton (ZA); Daniel August Julien Louis Maurissens, Sandton (ZA)

(73) Assignee: DETNET SOUTH AFRICA (PTY) LTD (ZA)

( * ) Notice: Subject to any disclaimer, the term of this patent is extended or adjusted under 35 U.S.C. 154(b) by 0 days.

(21) Appl. No.: 14/346,475

(22) PCT Filed: Sep. 21, 2012

(86) PCT No.: PCT/ZA2012/000058
§ 371 (c)(1),
(2) Date: Mar. 21, 2014

(87) PCT Pub. No.: WO2013/044275
PCT Pub. Date: Mar. 28, 2013

(65) Prior Publication Data

US 2014/0311370 A1 Oct. 23, 2014

(30) Foreign Application Priority Data

Sep. 22, 2011 (ZA) ..... 2011/06918

(51) Int. Cl.
*F42D 1/055* (2006.01)
*F42C 11/06* (2006.01)
*F42C 11/00* (2006.01)

(52) U.S. Cl.
CPC ..... *F42D 1/055* (2013.01); *F42C 11/001* (2013.01); *F42C 11/065* (2013.01)

(58) Field of Classification Search
CPC ..... F42C 11/00; F42C 11/001; F42C 11/007; F42C 11/06; F42C 11/065; F42B 22/06; F42D 1/055
USPC ..... 102/427
See application file for complete search history.

(56) References Cited

U.S. PATENT DOCUMENTS 4,495,851 A * 1/1985 Koerner et al. ..... 89/6.5
2010/0116165 A1* 5/2010 Moore ..... 102/311
2012/0299708 A1 11/2012 Guyon et al.

FOREIGN PATENT DOCUMENTS

WO 2010048587 A1 4/2009
WO 2011095730 A1 8/2011

OTHER PUBLICATIONS

International Preliminary Report on Patentability for PCT/ZA2012/000058, international filing date of Sep. 21, 2012, mailed Sep. 13, 2013, 12 pages.
International Search Report for PCT/ZA2012/000058, international filing date of Sep. 21, 2012, mailed Feb. 6, 2013, 5 pages.
Written Opinion for PCT/ZA2012/000058, international filing date of Sep. 21, 2012, mailed Feb. 6, 2013, 6 pages.

* cited by examiner

*Primary Examiner* — Stephen M Johnson
(74) *Attorney, Agent, or Firm* — Cantor Colburn LLP

(57) ABSTRACT

A method of communicating with a detonator device using radio frequency identification (RFID) technology to read data from the device, and to transmit information and commands to the device.

9 Claims, 3 Drawing Sheets

DETONATOR DEVICE COMMUNICATION

CROSS-REFERENCE TO RELATED APPLICATIONS

This application is a U.S. national stage application of International Application No. PCT/ZA2012/000058 entitled "DETONATOR DEVICE COMMUNICATION", which has an international filing date of 21 Sep. 2012, and which claims priority to South African Patent Application No. 2011/06918, filed 22 Sep. 2011.

BACKGROUND OF THE INVENTION

This invention relates generally to a method of and apparatus for communicating with a detonator device.

"Detonator device" is to be broadly interpreted herein and includes a detonator, a connector or arrangement which enables a detonator to be connected to a harness or to another component of a detonator system, a timing module for use with a detonator, and so on.

In most instances communication with a detonator is accomplished through the use of conductors, such as copper wires. Another technique, which is not as commonly employed, makes use of radio or wireless communication principles. In each case provision must be made in a detonator for a receiver/transmitter which is custom-designed for the purpose. This requirement adds to the cost of the end product.

US2010/116165 describes a tracking system for blast holes wherein a detonator is associated with a radio frequency identification device (RFID) tag. The tag carries a unique identity and may incorporate information about a blast hole with which it is associated, the location of the blast hole, blast hole coordinates and the like. Thus the RFID tag includes geographical information relation to the location of usage of the detonator. However the RFID tag does not include a capability of interacting with a control circuit which may be included in the detonator.

An object of the present invention is to enable communication to take place with a detonator device using alternative technology which can readily be implemented thereby possibly resulting in a cost reduction and in an enhancement of reliability of operation.

SUMMARY OF THE INVENTION

The invention provides a method of communicating with a detonator device which includes a control circuit and an RFID tag, the method being characterised by the step of using the RFID tag to read data, relating at least to the status of the detonator device, from the control circuit and to transmit information and commands to the control circuit, wherein the information and commands are selected at least from the following: instructions for verifying detonator functionality; calibration processes and the setting of timing periods.

"RFID" stands for radio-frequency identification. This is a technology in which communication is effected through the use of radio waves to transfer data between a reader and an electronic tag. Typically magnetic fields are used for this purpose but electromagnetic field-based tags are also available.

RFID technology, to the applicant's knowledge, has been used for the identification, tracking and management of assets and objects. In the field of detonators the applicant is aware of the use of an RFID tag to provide an identifier for a detonator which subsequently enables blasting equipment to communicate uniquely with the detonator through a different communication means e.g. via a two-wire connection to the detonator. RFID tags have also been used to assist in tracking movement, and controlling levels of stock, of detonators.

The method of the invention, however, proposes the use of RFID technology as a communication and control means with a detonator device.

In accordance with one aspect of the method of the invention the data which is read from the detonator device may relate to one or more of the following:

a) manufacturing and usage information such as a serial or identity number;

b) test results;

c) tracking data, manufacturing location;

d) permitted distribution or use region;

e) customer identity;

f) calibration data including temperature compensation maps, oscillator tuning, trigger levels and timing settings for on-board sensors, trimming parameters for analogue circuitry;

g) the results of self-test and self-diagnosis routines which may, themselves, be initiated through the use of RFID technology;

h) voltage and energy storage capacity of a battery associated with the detonator device;

i) the measurement of one or more parameters associated with circuitry linked to the device such as voltage, resistance, current, capacitance, inductance, frequency, time period duration;

j) data relating to the status of the detonator device e.g. is the detonator device or a detonator associated with the device able to respond to a firing demand?;

k) data which has been logged in respect of activities of the detonator device e.g. commands directed to the detonator device, and commands associated with operation of the detonator device such as calibration, arming and firing signals; and l) the reading of registers or of any memory component associated with the detonator device.

Information of the aforementioned kind, which is exemplary and non-limiting, is useful in ensuring successful and safe operation of a detonator and, in the event of a detonator misfire, such information may be of assistance in establishing the cause of the misfire.

The reading of the data from the detonator device may be accomplished through access control means which in turn may require the use of one or more passwords, encryption keys, biometrics or other security arrangements in order to elicit a response.

The reading of data from the detonator device may result in a unique entry in a data log memory of the detonator device.

The transmission of information and commands to the detonator device may be in respect of one or more of the following:

Information a) manufacturing information including serial or identity numbers, test results, tracking data, manufacturing locations, permitted distribution and use regions, customer identity;

b) calibration data including temperature compensation maps, oscillator tuning, trigger levels and timer settings for on-board sensors, trimming parameters for analogue circuits, and so on;

c) the results of factory tests and diagnostic routines;

d) data relating to a programmed initiation time;

e) data relating to the setting of access passwords, encryption keys or other security arrangements;

f) data relating to the setting of fire or enable commands to allow control over one or more detonators to be regulated on an area of usage or on another basis;

g) the erasing or writing of log data; and h) information directed to registers and memory devices associated with the detonator device.

Commands a) the initiation of a self-test, battery test or other command;

b) enabling the detonator device to respond to a fire command;

c) enabling or disabling specific circuitry or functions of circuitry of the device;

d) permanently disabling the detonator device thereby preventing the detonator device from being fired or from being used in a fire chain;

e) information and commands may be implemented in terms of a "write command" i.e. the detonator device may function as a memory-mapped device.

It is possible to use access control techniques, based on the use of passwords, biometrics, encryption keys, or other security means, in order to write to the device or to elicit a response from the device.

The referenced information and commands are exemplary, and non-limiting.

The method of the invention may include the step of using a wireless signal, transmitted through the use of RFID technology to the detonator device, to power the detonator device or to charge an internal storage mechanism such as a capacitor in the detonator device.

In one particular application the detonator device is a detonator which includes a metallic tube, e.g. of copper or aluminium, in which the remaining components of the detonator are housed. An RFID tag may then be mounted inside the tube. Communication with the tag takes place at radio frequencies and, due to the metallic structure in which the tag is located, a loss of signal strength caused by eddy currents in the tube is inevitable. This aspect may be addressed, when sending a signal to the RFID tag, by using a more powerful transmitter. However, in the return direction, from the tag to a reader, the data is typically sent using a technique known as backscattering and the degree of coupling between the reader and the tag may also be influenced by the metal tube. To address this problem use may be made of a suitable modulation technique and a sensitive receiver at the reader. Alternatively or additionally it may be possible to incorporate an antenna which is connected to the tag and which is positioned externally of the metallic tube or close to an unshielded ("open") end of the tube thereby to limit transmitted signal strength reduction.

In a different approach the antenna is replaced by a first electrode which forms part of a capacitor which establishes a communication link with the RFID tag.

Preferably the detonator is engageable with a communication source which is connected to a second electrode which forms a further part of the capacitor.

The invention further extends to a detonator arrangement which includes a detonator device and an RFID tag connected to the device for communicating with the device.

The RFID tag may be a passive or active tag i.e., in the latter case, it may include a power source.

In another approach use is made of a battery-assisted passive tag. A small battery in the device is kept in a standby mode with very low current consumption. The battery is activated, i.e. it is fully connected to all the circuitry in the device which is thereby made operational, upon reception of an appropriate command from an RFID reader.

The detonator device may be a connector which is used to make a connection between a detonator and a harness or another component in a detonator system, or it may comprise a detonator.

Preferably the RFID tag is associated with an integrated circuit used for controlling operation of the detonator device. The tag may be incorporated, as an original component, in the integrated circuit.

Thus, in accordance with this aspect of the invention, communication with a control circuit of a detonator is implemented through the means of an RFID tag which acts as a communication conduit to the control circuit.

Communication signals or commands may be proprietary or comply with a standard RFID specification. It is pointed out in this respect that a standard RFID specification, e.g. ISO15693, makes allowances for manufacturer extensions to an existing or standard command set.

Communication between the RFID tag and an external device may be achieved by means of inductive coupling. For example a coil which forms part of the RFID tag may be used for inductive coupling. The invention is not limited to the use of this particular technique though for different mechanisms can be employed e.g. communication can be achieved via variations in an electrical field.

For example an open capacitor can be employed whereby a varying electrical field is established between a first capacitor plate and to which a second capacitor plate is responsive. In this application a suitable detonator tube is treated as one electrode and a second electrode is provided, for example, by moulding a conductive component into a plug that is used to seal the detonator tube. The conductive component is then regarded as forming the second plate of a capacitor. A similar construction may be adopted in an external device, such as a tagger, which includes two spaced apart electrodes, one of which is associated or aligned, and makes electrical contact, with the detonator tube. The other electrode is the first capacitor plate that is associated with the conductive component which is embedded in the detonator plug.

No electrical contact is made between the two sets of electrodes. However an electric field established between one pair of electrodes is detectable by (transferred to) the other pair of electrodes and in this way communication is effected. The use of a capacitive coupling technique, in place of an inductive coupling technique, can be adopted without altering the remaining aspects of the invention.

BRIEF DESCRIPTION OF THE DRAWINGS

The invention is further described by way of examples with reference to the accompanying drawings in which.

DESCRIPTION OF PREFERRED EMBODIMENTS

Figure 1:
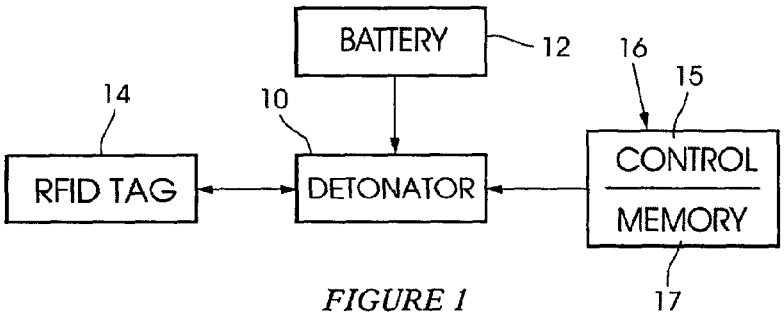
FIGS. 1, 2 and 3 show in block diagram form respective embodiments of the invention.

FIG. 1 of the accompanying drawings illustrates in block diagram form a detonator 10 which is connected to a battery 12, and an RFID tag 14. The RFID tag, in itself, is of conventional construction. Typically the tag allows for the receipt and transmission of a large number of signals in accordance with a predetermined standard. Usually, however, only a limited number of the signals are used when the tag is employed for traditional applications of the kind referred to hereinbefore. In this respect the invention is based on the premise that extensions in an existing standard command set can be employed for communicating with the detonator 10.

The detonator is of conventional construction and includes a controller 15, embodied in an integrated circuit 16, and a memory 17 which is also embodied in the integrated circuit. Commands and other information are directed to the circuit via the medium of the RFID tag which thus functions purely as a communication channel between external structure and the control circuit. The RFID tag, in this respect, replaces a conventional wireless or conductor arrangement which would otherwise be used for channeling signals to and from the controller.

Figure 2:
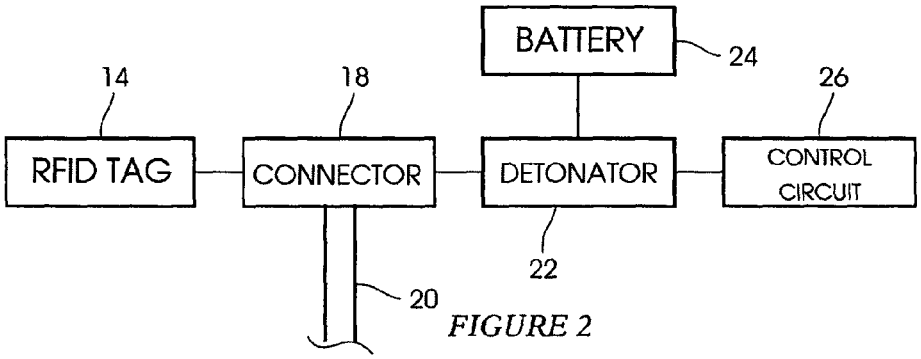

FIG. 2 shows another configuration which makes use of the principles of the invention. An RFID tag 14 is associated with a connector 18 which is connected to a harness 20. The tag 14 may, for example, be included in a housing of the connector or it may be associated with the connector in any other appropriate manner.

In the establishment of a blasting system the connector 18 is connected to a detonator 22, and is thus used in the making of a communication channel to the detonator 22. The detonator has an on-board battery 24 used for powering circuits in the detonator. Alternatively the battery is incorporated into the connector 18.

In the manner which has been described communication with a control circuit 26, typically an integrated circuit or a microprocessor, is accomplished using extensions to a standard command set associated with the tag. The circuit 26 corresponds to the circuit 15 in FIG. 1.

In each embodiment data transfer takes place through the medium of the RFID tag 14. The data may be of the kind referred to hereinbefore and may be stored in the memory 17 (FIG. 1) or in the control circuit 26 (FIG. 2). Conversely, information and commands from an external controller, not shown, can be transmitted to the detonator using the communication protocol which is automatically made available by means of the RFID tag. A significant benefit in this respect is that the RFID technology, available through the use of the tag, is employed without the development of dedicated communication protocols.

When the RFID tag is directly associated with the detonator the RFID capability is preferably embedded in the control circuit, normally an integrated circuit, used for controlling operation of the detonator—this reduces manufacturing costs and enhances reliability of operation of the detonator.

Figure 3:
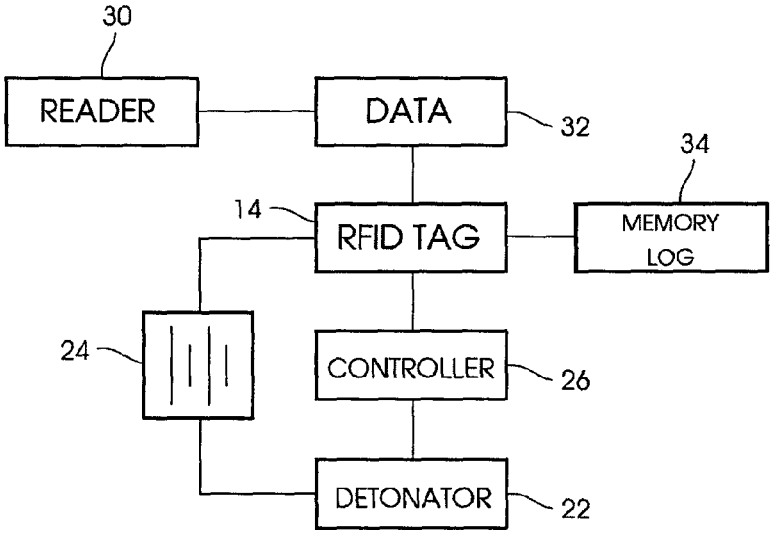

FIG. 3 illustrates further possible details of the arrangement shown in FIG. 1. The RFID tag 14 is, as noted, preferably directly associated with a controller 15 so that the RFID facility is incorporated in an integrated circuit which also provides a detonator control function. The RFID tag may be a battery-assisted RFID tag. Thus, in a standby mode, a battery 24 is not connected to the tag. However, upon exposure to an interrogating signal from an RFID reader 30 which reads data 32, the tag is activated and the battery 24 can be employed for a detonator control function and to provide energy to fire the detonator 22.

The information which is transmitted to the detonator may be of the kind which is herein described. Similarly commands to the detonator may include a full operational set of instructions for verifying detonator functionality, calibration processes, the setting of timing periods and for arming and/or firing. Typically firing would be accomplished through other means such as an alternative wired or wireless communication mechanism or by means of a shocktube trigger input to the detonator device.

A log can be kept in a memory 34 (or 17) which records each time information or commands are transmitted to the controller 26 (or 15). This feature is particularly useful if a detonator fails to fire when a firing signal is given. If the detonator can be retrieved and interrogated, then it might be possible to access the log and thereby determine at what point, or for what reason, detonator failure occurred.

The data and commands which are transmitted to and from the detonator are not limited. In general terms data commands necessary for the effective, reliable and safe control of the functioning of the detonator can be transmitted. Preferably use is made of known protocols, such as ISO 15693, by accessing manufacturer reserved protocol extensions. Alternatively, new command or modulation schemes or combinations of existing standards can be adopted, as may be appropriate. A proprietary protocol or access control technique, based on the use of a password, an encryption process, biometrics, or the like may be adopted to improve the security of the device and, in particular, to avoid tampering with the device taking place through the use of a conventional RFID reader or development kit. On the other hand, compatibility with existing standards, at least to some extent, enables interoperability with existing RFID scanning facilities and allows for integration with existing stock control tools. Thus a hybrid approach may be employed.

Figure 4:
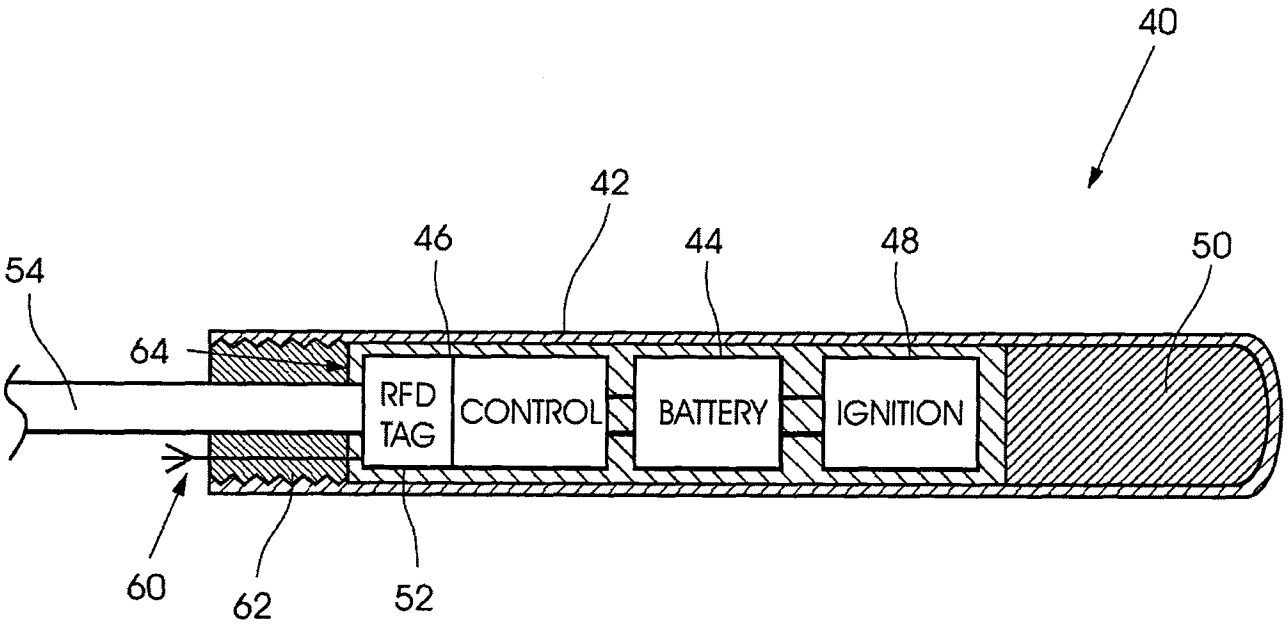
FIG. 4 shows a possible construction of a detonator.

FIG. 4 shows a detonator 40 which includes a metallic tube 42 in which are located a battery 44, a control circuit 46, an ignition element 48, and primary and secondary explosive charges 50. The control circuit 46 includes an RFID tag 52. Any appropriate signal transmission device 54, e.g. a shock tube, may be connected to the detonator in the establishment of a blasting system.

The RFID tag 52 may be battery-assisted. The tag includes an antenna 60 which is used for transmitting and receiving signals. If signal transmission takes place the metallic enclosure, constituted by the housing 42, automatically leads to a signal strength reduction. To help in this respect the antenna 60, which is connected to the RFID tag, is encapsulated in a plastics material 62, and is located close to a mouth 64 of the metallic housing 42. The material 62 acts as a non-conductive plug for the housing.

The use of RFID technology simplifies communication with a detonator. Additionally RFID tracking and asset control facilities are automatically available.

As indicated hereinbefore capacitive coupling techniques can be employed to establish communication links with a detonator.

Figure 5:
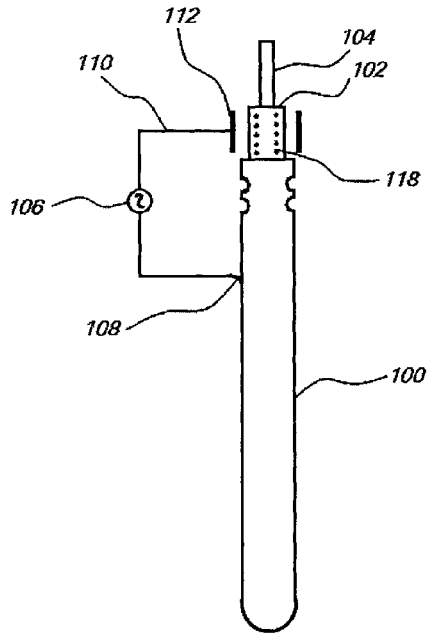
FIG. 5 depicts a physical layout for a contactless capacitive communication interface with a detonator.
Figure 6:
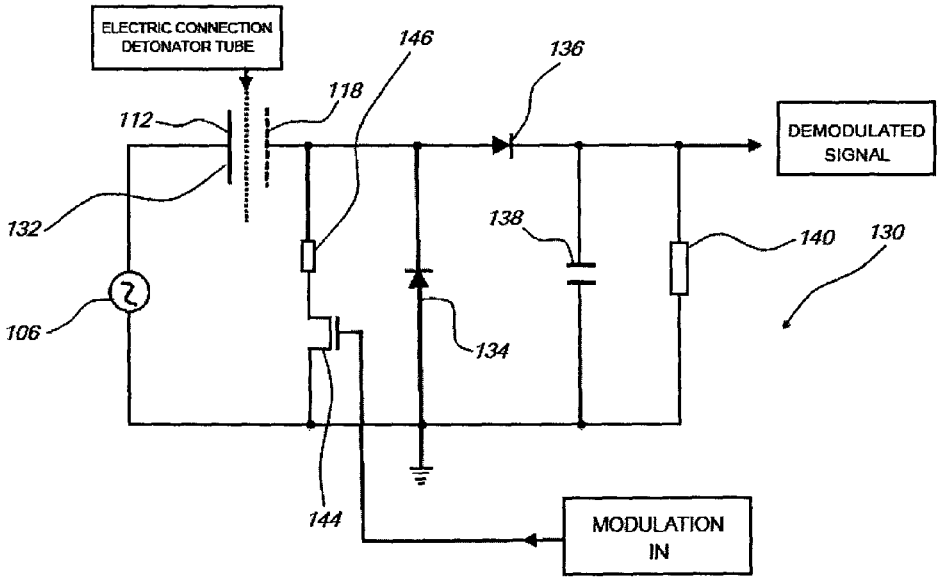
FIG. 6 shows an electrical circuit which is implemented through the use of the arrangement in FIG. 5.

FIG. 5 shows a mechanical arrangement for a contactless capacitive communication interface with a detonator while FIG. 6 illustrates an electrical circuit which is established through the use of the arrangement in FIG. 5.

FIG. 5 shows a detonator tube 100 with a crimp plug 102 which is used to attach a shock tube 104 to the detonator.

A communication generator 106 is used to communicate with a circuit associated with the detonator. The generator 106 may be a voltage generator that is modulated in any appropriate way e.g. amplitude modulated, frequency modulated or phase modulated. These are exemplary techniques only and are non-limiting.

The generator functions at a communication frequency which may for example lie in the ISM (Industrial, Scientific and Medical) band.

The generator 106 has one terminal connected to a sliding contact 108 made from a resilient material, and a terminal 110 which is connected to a cylindrical-shaped metal coupling electrode 112. The arrangement is such that the detonator tube can be inserted into a holder, not shown, which correctly positions the crimp plug 102 in relation to the cylindrical electrode 112. At the same time the contact 108 comes into connection with the conductive detonator tube 100. A sound electrical contact between the last-mentioned components is achieved by making the contact 108 from a resilient material or by using a simple spring-loaded slide contact.

The crimp plug 102 which is made from a suitable insulating material, e.g. an isolating polymer, has embedded in it a cylindrical metal ring 118. When the components are relatively positioned as shown in FIG. 5 the capacitive coupling electrode 112 is directly opposed to the ring 118. The detonator is then in a communication position for capacitive coupling is established between the generator 106 and a circuit inside the detonator (RFID tag) via the medium of the components 100, 108, 112 and 118.

FIG. 6 illustrates an electrical circuit 130 which is established through the use of the mechanical arrangement shown in FIG. 5. Assume for the sake of example that the communication generator 106 works on amplitude modulated techniques. As noted this is an exemplary and non-limiting embodiment of the invention. The inner and outer electrodes 118 and 112 respectively form a capacitor 132 that couples a signal from the generator 106 to a circuit inside the detonator. Diodes 134 and 136, respectively, together with a capacitor 138 and a resistor 140 form a voltage doubling envelope demodulator which delivers a demodulated signal, originating in the generator 106, to a circuit inside the detonator.

In the return direction a signal from inside the detonator is transmitted by load modulation of the carrier signal of the generator 106. This load modulation is realised by a transistor 144 which is combined with a load resistor 146. The load modulation is detectable at the generator 106 and the return signal from the detonator can be recovered.

The invention claimed is:

1. A method of communicating with a detonator device which device includes a metallic detonator tube within which are disposed a control circuit, an RFID tag, an ignition element and an explosive charge, the control circuit and the RFID tag being connected to each other, the method comprising the step of using the RFID tag to read data from the control circuit, the data relating at least to the status of the detonator device, and to transmit information and commands to the control circuit, wherein the information and commands are selected at least from the following: instructions for verifying the detonator functionality; calibration processes and the setting of timing periods.

2. A method according to claim 1 wherein the data read from the control circuit is additionally selected from one or more of the following:

a) manufacturing and usage information;
b) test results;
c) tracking data, manufacturing location;
d) permitted distribution or use region;
e) customer identity;
f) calibration data;
g) the results of self-test routines;
h) voltage and energy storage capacity of a battery associated with the detonator device;
i) the measurement of one or more parameters associated with circuitry linked to the device;
j) data which has been logged in respect of activities of the detonator device; and
k) the reading of any memory component associated with the detonator device.

3. A method according to claim 1 wherein the information and commands transmitted to the control circuit are additionally selected from one or more of the following:

Information:
a) manufacturing information;
b) calibration data;
c) the results of factory tests and diagnostic routines;
d) data relating to a programmed initiation time;
e) data relating to the setting of access passwords;
f) data relating to detonator control;
g) the erasing or writing of log data; and
h) information directed to a memory device associated with the detonator device:

Commands:
a) the initiation of a command;
b) enabling the detonator device to respond to a fire command;
c) enabling or disabling specific circuitry of the device; and
d) permanently disabling the detonator device.

4. A method according to claim 3 wherein the reading of data from the control circuit and the transmission of information and commands to the control circuit are accomplished using extensions to a command set of the RFID tag.

5. A method according to claim 1 or claim 2 wherein the reading of data from the control circuit and the transmission of information and commands to the control circuit are accomplished using extensions to a command set of the RFID tag.

6. A detonator arrangement which includes a detonator device comprising a metallic detonator tube within which are disposed both a control circuit and an RFID tag and wherein the RFID tag is used to read data from the control circuit and to transmit information and commands to the control circuit.

7. A detonator arrangement which includes a detonator device, a control circuit and an RFID tag, wherein the RFID tag is used to read data from the control circuit and to transmit information and commands to the control circuit, the arrangement further comprising a metallic detonator tube having a mouth, a battery, the control circuit, an ignition element and an explosive charge, wherein the battery, the control circuit, the ignition element and the explosive charge are located inside the tube, and the RFID tag is connected to the control circuit, a non-conductive plug is engaged with the mouth of the tube, and a communication component is connected to the RFID tag and embedded in the plug.

8. A detonator arrangement according to claim 7 wherein the communication component comprises an antenna.

9. A detonator arrangement according to claim 7 wherein the communication component comprises a first electrode which forms part of a capacitor which establishes a communication link with the RFID tag, and the second tube constitutes a second electrode of the capacitor.

* * * * *